US007612664B2

(12) United States Patent
Huang et al.

(10) Patent No.: US 7,612,664 B2
(45) Date of Patent: Nov. 3, 2009

(54) REFRIGERATED CONTAINER

(75) Inventors: Tian Hua Huang, Qingdao (CN); Guohao Huang, Qingdao (CN); Hu Liang, Qingdao (CN); Jim Sun, Qingdao (CN)

(73) Assignee: Qingdao CIMC Special Reefer Co., Ltd., Qingdao (CN)

( * ) Notice: Subject to any disclaimer, the term of this patent is extended or adjusted under 35 U.S.C. 154(b) by 238 days.

(21) Appl. No.: 11/623,152

(22) Filed: Jan. 15, 2007

(65) Prior Publication Data

US 2007/0193319 A1 Aug. 23, 2007

(30) Foreign Application Priority Data

Jan. 16, 2006 (CN) ..... 200610033102

(51) Int. Cl.
*G08B 1/08* (2006.01)

(52) U.S. Cl. ..... 340/539.31; 340/539.1; 340/539.16; 340/539.13; 340/539.22; 340/686.1; 340/825.36; 340/825.49

(58) Field of Classification Search ..... 340/545.1, 340/539.31, 545.2, 545.8, 550, 551, 552, 340/539.1, 539.16, 539.13, 539.22, 539.23, 340/548, 686.1, 825.36, 825.49
See application file for complete search history.

(56) References Cited

U.S. PATENT DOCUMENTS 6,879,257 B2 * 4/2005 Hisano et al. ..... 340/568.2
7,154,394 B2 * 12/2006 Zhou ..... 340/568.8
7,417,543 B2 * 8/2008 Bergman et al. ..... 340/545.6

FOREIGN PATENT DOCUMENTS

CN 200410056197.7 6/2005

* cited by examiner

*Primary Examiner*—Daryl Pope
(74) *Attorney, Agent, or Firm*—Foley & Lardner LLP

(57) ABSTRACT

A refrigerated container comprising a door composed of a first and a second door panels and a security device is disclosed. The security device includes a detection plate fixed to an inner side of the first door panel which has a free end extending towards the second door panel; a displacement sensor fixed to an inner side of the second door panel to cooperate with the free end of the detection plate; a monitoring module; and an antenna. Said displacement sensor, monitoring module and antenna are separately arranged in the door, and said monitoring module is arranged within a heat insulating layer in the first door panel or the second door panel, and said antenna is provided at an outer side of the first door panel or the second door panel.

17 Claims, 4 Drawing Sheets

REFRIGERATED CONTAINER

FIELD OF THE INVENTION

The present invention relates to a container, and more particularly to a refrigerated container.

BACKGROUND OF THE INVENTION

Refrigerated containers, as containers for meeting requirements in heat-insulating, refrigerating and freezing of goods, can attain an objective of delaying spoilage of goods contained therein by controlling atmosphere, temperature, and humidity inside the containers by means of, for example, preservation measures and air-conditioning measures. For many years, to ensure a safe transportation, the refrigerated containers always, like those general containers, use a mechanical closure with a globally unique identification code to lock a locking handle of the container door panels. Thus, it could be easily determined whether the container has been tampered during transport. However, the mechanical closure has a drawback of being susceptible to destruction and camouflage, thus resulting in a poor level of security.

To achieve real-time monitoring of the container during its transportation, an electric closure has emerged in place of the mechanical closure. Once the electric closure is unauthorizedly opened, a monitoring module of the electric closure will emit alarming signals via an antenna. However, since the electric closure works by locking a locking handle into a corresponding handle seat, and rivets for mounting the handle seat on the door panel is susceptible to destruction and camouflage, a security level of the electric closure is greatly impaired.

To better monitor unauthorized opening of the container door, a technical solution about a safety container is disclosed in a Chinese patent application No. 200410056197.7 filed on Aug. 18, 2004. In this technical solution, a detection plate is arranged on an inner side of one of the two door panels of the container. A monitoring module, a displacement sensor and an antenna which are integrally formed are correspondingly arranged on the other one of the door panels. The displacement sensor and the antenna are arranged to protrude from two opposite side surfaces of the monitoring module around one end portion thereof. Further, the displacement sensor protrudes towards an interior of the container and cooperates with the detection plate, and the antenna protrudes out of the container via a hole formed in the container door panels. Once the door is unauthorizedly opened, a relative displacement will occur between the two door panels, and thus the displacement sensor detects such a displacement and sends a signal indicating that the door is unauthorizedly opened to the monitoring module, and then the monitoring module emits alarming signals via the antenna.

To some extent, the technical solution described above may solve the problem of determining whether the general container door is unauthorizedly opened. However, certain disadvantages will be caused when the above-mentioned technical solution is applied in a refrigerated container provided with a foamed heat insulating layer which serves to prevent a heat exchange between inside and outside of the container. On the one hand, integrally formed displacement sensor, antenna and monitoring module are not easily mounted in the door. On the other hand, the displacement sensor and the antenna respectively protruding towards the interior and exterior of the container at the end portion of the monitoring module will damage initial structures of the heat insulating layer of the container door so as to cause a heat exchange between inside and outside of the container and thus deteriorate a heat-insulating performance of the refrigerated container door panels.

SUMMARY OF THE INVENTION

The present invention aims to provide a refrigerated container which is capable of overcoming the above-mentioned drawbacks in the prior art.

To accomplish the object of the present invention, there is provided comprising a security device and a door composed of a first door panel and a second door panel, said security device including: a detection plate having a first end fixed to an inner side structure of the first door panel, and a second opposite end as a free end extending towards the second door panel and being positioned behind an inner side structure of the second door panel when the door is closed; a displacement sensor fixed to the inner side structure of the second door panel and positioned adjacent to the free end of the detection plate so as to cooperate with the free end of the detection plate and to thus detect a relative displacement between the two door panels; a monitoring module electrically connected to the displacement sensor to receive and process outputs from the displacement sensor; and an antenna electrically connected to the monitoring module to receive and emit outputs from the monitoring module; wherein said displacement sensor, monitoring module and antenna are separately arranged in the door, and said monitoring module is arranged within a heat insulating layer in the first door panel or the second door panel, and said antenna is provided at an outer side of the first door panel or the second door panel.

In an aspect of the refrigerated container according to the present invention, in case of arranging in the same door panel, said displacement sensor, monitoring module and antenna are connected with each other by means of electrical wires or cables embedded into said heat insulating layer of said the same door panel.

In an aspect of the refrigerated container according to the present invention, said displacement sensor is a travel switch, said inner side structure of the second door panel comprises an inner lining, and the travel switch is fixed to the inner lining; and a contact pin of the travel switch protrudes out of the inner lining, and said free end of the detection plate is configured to press against the contact pin of the travel switch when the door is closed and release the contact pin of the travel switch when the door is opened so as to switch states of the travel switch.

In an aspect of the refrigerated container according to the present invention, said displacement sensor is a Hall sensor, said inner side structure of the second door panel comprises an inner lining, and the Hall sensor is fixed to the inner lining; and said free end of the detection plate includes magnetic conductive materials configured to face the Hall sensor when the door is closed.

In an aspect of the refrigerated container according to the present invention, said displacement sensor is a Hall sensor, said inner side structure of the second door panel comprises an inner lining, and the Hall sensor is fixed to the inner lining; and said free end of the detection plate includes a magnetic member, and said magnetic member is fixed to a portion of said detection plate which faces the Hall sensor when the door is closed.

In an aspect of the refrigerated container according to the present invention, said displacement sensor is a proximity switch, and said inner side structure of the second door panel comprises an inner lining and a U-shaped member fixed to the inner lining; and the proximity switch is fixed to one of two opposite side walls of the U-shaped member, and a magnetic member opposite to the proximity switch is fixed to the other one of the two opposite side walls of the U-shaped member; and said free end of the detection plate includes a bent portion which is inserted into a gap between the two opposite side walls of the U-shaped member and prevents magnetic lines of the magnetic member from reaching the proximity switch when the door is closed.

In an aspect of the refrigerated container according to the present invention, said proximity switch is a normally closed type or a normally open type of reed switch.

In an aspect of the refrigerated container according to the present invention, said proximity switch includes two reed switches electrically connected in series and arranged to be substantially in parallel with the inner lining and to be spaced apart from each other; and one of said two reed switches near an opening of said U-shaped member is a normally open type, the other one away from the opening of said U-shaped member is a normally closed type.

In an aspect of the refrigerated container according to the present invention, the refrigerated container further comprises a reinforcer of heat-insulating materials arranged within the first door panel and abutting against an inner lining of the first door panel, said detection plate being fixed to the reinforcer of heat-insulating materials.

In an aspect of the refrigerated container according to the present invention, said antenna is arranged within an anti-collision block mounted on a pivot hinge of the first door panel or the second door panel.

The refrigerated container implemented by the present invention has the following beneficial effects:

1) By separately arranging the monitoring module, the displacement sensor and the antenna at different locations of the container door, an enhanced convenience of installing the security device on the refrigerated container door is achieved, while an excellent heat-insulating property of the door panel is ensured.

2) It also provides a good protection for the monitoring module by means of the foamed heat insulating layer in the door panels.

BRIEF DESCRIPTION OF THE DRAWINGS

The present invention will be described in detail with reference to the accompanying drawings and the embodiment(s). In the drawings.

DETAILED DESCRIPTION OF THE INVENTION

Figure 1:
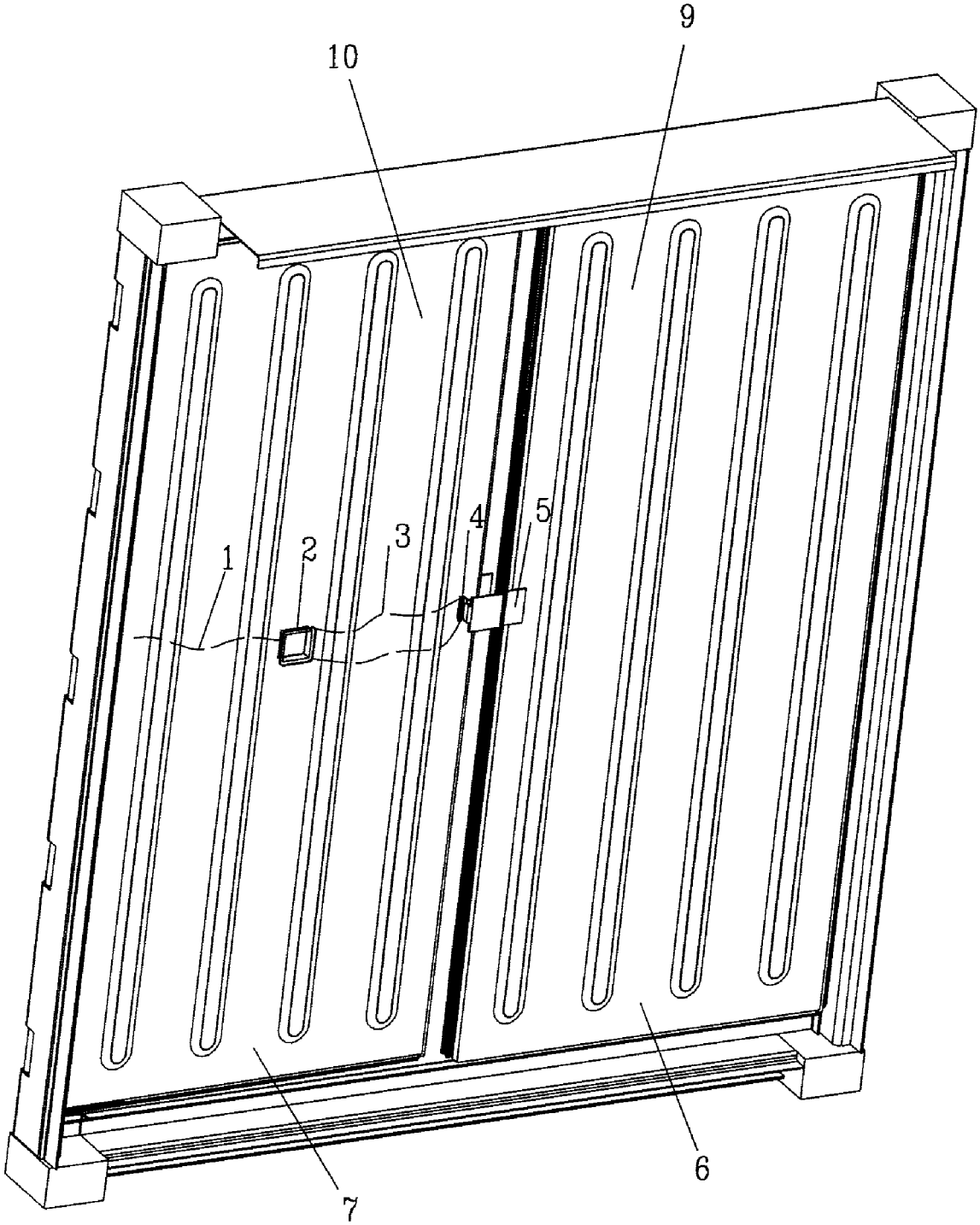
FIG. 1 is a schematic view showing structural details near door panels of the refrigerated container in accordance with the invention, with a security device installed at inner sides of the door panels.
Figure 2:
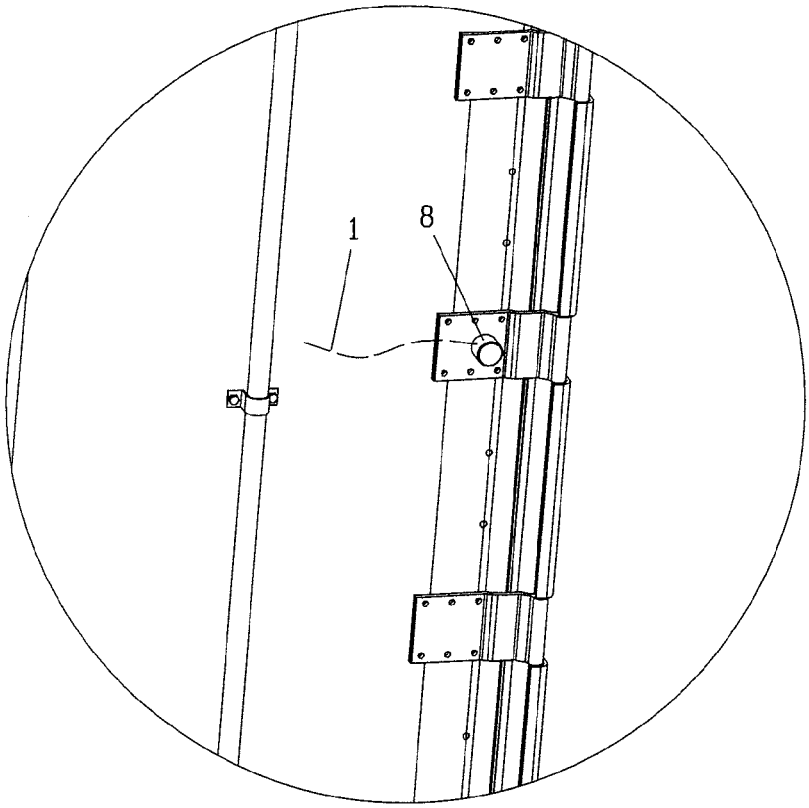
FIG. 2 shows an embodiment in which an antenna of the security device is installed outside the door panels.
Figure 3:
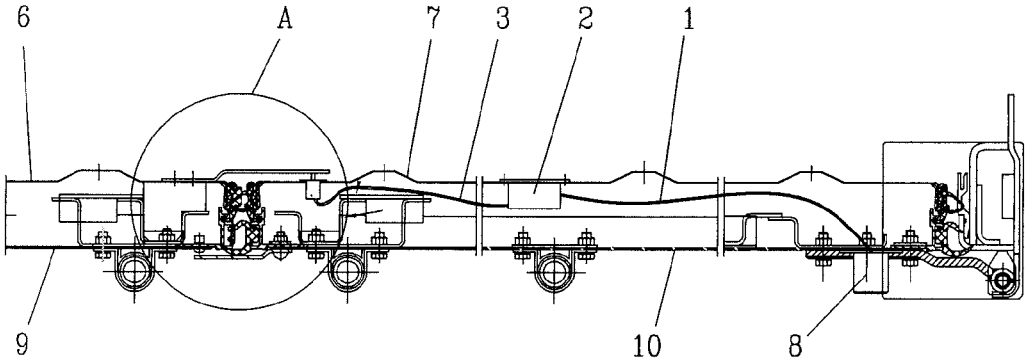
FIG. 3 is a cross-sectional view illustrating the security device installed on the door panels.

As shown in FIGS. 1, 2 and 3, a refrigerated container in accordance with the present invention includes a security device comprising a detection plate 5, two door panels 9 and 10, a monitoring module 2, a displacement sensor 4 and an antenna 8. The detection plate 5 has one end fixed to an inner side structure, e.g. inner lining 6 of the door panel 9, and the other opposite end as a free end extending towards the door panel 10 so that the free end of the detection plate 5 will be positioned behind an inner side structure of the door panel 10 when the door is normally closed. The displacement sensor 4 is fixed to the inner side structure of the door panel 10 and approximates the free end of the detection plate 5 so as to cooperate with the free end of the detection plate 5 and to thus detect a relative displacement between the two door panels. The monitoring module 2 is arranged within a heat insulating layer in the door panel 10, and is electrically connected to the displacement sensor 4 to receive and process outputs from the displacement sensor 4. The antenna 8 is disposed within an anti-collision block on an outer side of the door panel 10 and near a pivot hinge of the door panel 10, and is electrically connected to the monitoring module 2 to receive and emit outputs from the monitoring module 2. According to the present invention, the monitoring module 2, the displacement sensor 4 and the antenna 8 are three components separately arranged in different locations of the container door. Particularly, in case of arranging in the same door panel, the displacement sensor, monitoring module and antenna are connected with each other by means of electrical wires or cables embedded into the heat insulating layer of the same door panel.

The inner side structures of the door panels may usually comprise inner linings. However, the inner side structures may further comprise a heat insulating structure connected to the inner side structure of the outside board of the door panel and exposing the inner lining of the door panel.

In another embodiment, the detection plate 5 may be fixed to the door panel 10, and accordingly the displacement sensor 4 is fixed to the door panel 9. In general, the monitoring module 2 and the antenna 8 are arranged on the same door panel as the displacement sensor 4. However, by arranging the monitoring module 2 and the antenna 8 on the same door panel as the detection plate 5 and ensuring an electrical connection of the monitoring module 2 to the displacement sensor 4 as well as the antenna 8, the inventive object can also be accomplished.

In addition, the antenna 8 may be arranged at other suitable portions of the outer side of the door panel, for example, in the vicinity of the locking handle, etc.

For enhancing the strength of a portion of the inner lining 6 where the detection plate 5 is connected, there is provided a reinforcer 61 (see FIG. 4) of heat-insulating materials within the door panel 9. One end of the reinforcer 61 is fixed to another reinforcer 62 for reinforcing the strength of a part of the outer side of the door panel 9 where the locking handle is connected, and the other opposite end thereof just abuts against the inner lining 6. The detection plate 5 is fixed to the other opposite end of the reinforcer 61 of heat-insulating materials by means of screws.

The displacement sensor 4 may be embodied as suitable proximity switches, for example, a travel switch, a Hall switch, a reed switch, and the like, which will be described in detail hereinafter.

A First Embodiment of the Displacement Sensor 4

Figure 4:
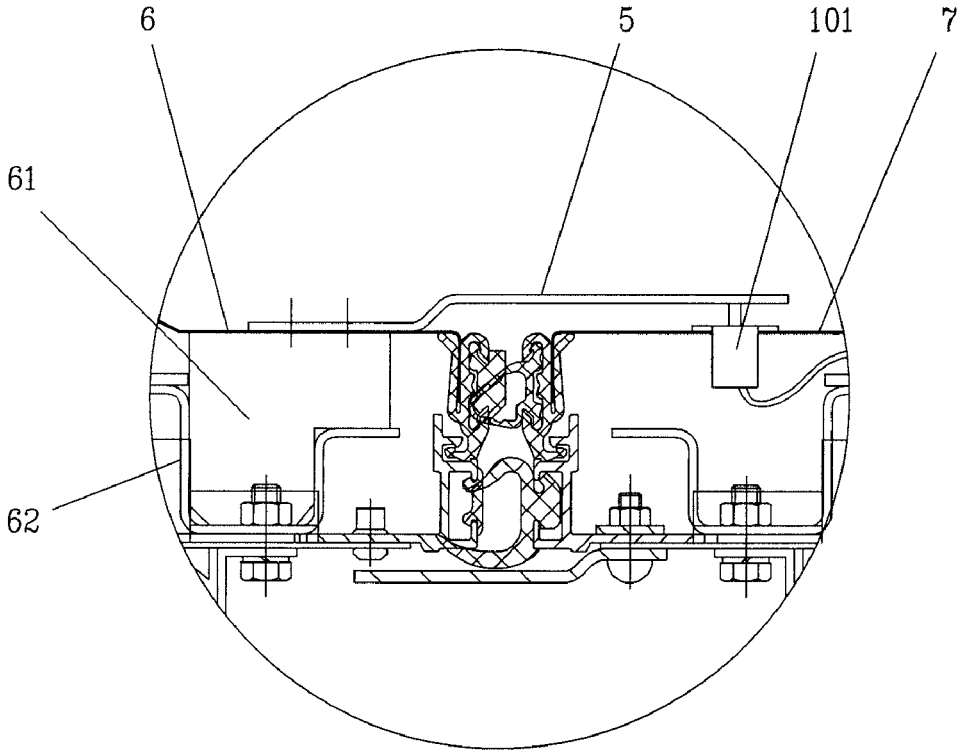
FIG. 4 is an enlarged view of part A in FIG. 3, showing a first embodiment of the displacement sensor.

As shown in FIG. 4, in this embodiment, the displacement sensor is implemented as a travel switch 101 fixed to the inner lining 7 of the door panel 10. Essential portions of the travel switch 101 are disposed within a foamed heat insulating layer in the door panel 10. Further, a contact pin of the travel switch 101 protrudes out of the inner lining 7 of the door panel 10. In the event that the door is completely closed, the aforementioned free end of the detection plate 5 presses against the contact pin of the travel switch 101 and thus the travel switch 101 has a predetermined state, e.g. "ON" or "OFF". Once the free end of the detection plate 5 releases engagement with the contact pin of the travel switch 101, the state of the travel switch 101 will be switched, for example, from "OFF" to "ON" (a normally open type) or vice versa (a normally closed type), and at the same time a signal indicating that the door is closed or opened is transmitted to the monitoring module 2. Accordingly, once occurrence of unauthorized opening of the door, the travel switch 101 will transmit signals to the monitoring module 2 indicating that the door is unauthorizedly opened.

A Second Embodiment of the Displacement Sensor 4

Figure 5:
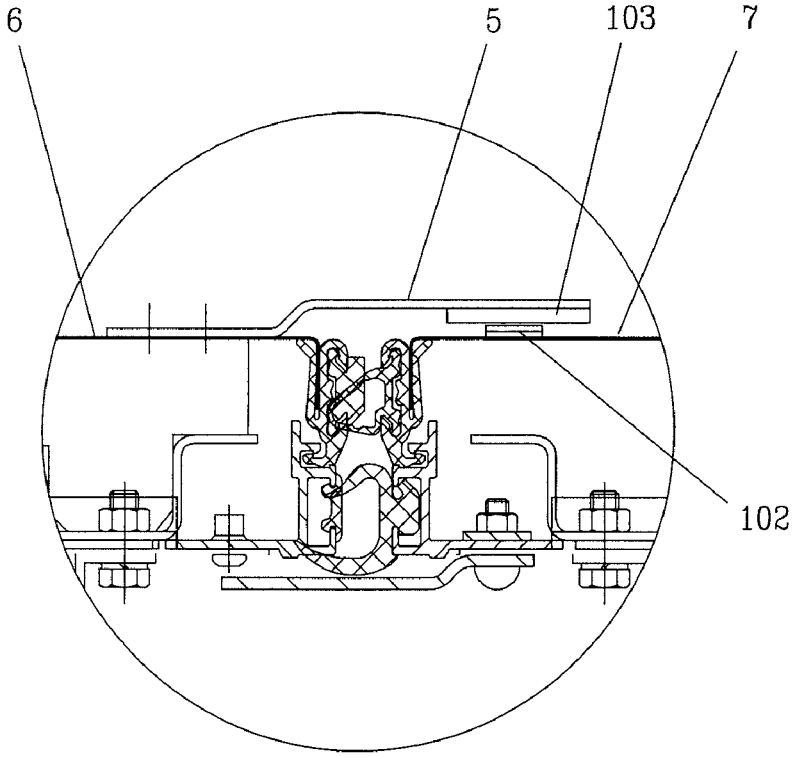
FIG. 5 is an enlarged view of part A in FIG. 3, showing a second embodiment of the displacement sensor.

As shown in FIG. 5, in this embodiment, the displacement sensor is implemented as a Hall sensor 102 fixed to an outer surface of the inner lining 7 of the door panel 10. A magnetic member 103 such as magnet, magnetic rubber, etc. is disposed on a portion of the detection plate 5 facing the Hall sensor 102 by glue or screws.

Instead of disposing the magnetic member on the detection plate 5, the detection plate 5 or at least the portion of the detection plate 5 facing the Hall sensor 102 may be formed of magnetic conductive materials or magnetic materials.

When the magnetic member 103 or the magnetic conductive materials of the detection plate 5 approaches or moves away from the Hall sensor 102, state of the Hall sensor 102 will vary, for example, from "OFF" to "ON" (a normally open type) or from "ON" to "OFF" (a normally closed type), and in turn a signal indicating the door is closed or opened is transmitted to the monitoring module 2. Upon occurrence of unauthorized opening of the door, the Hall sensor 102 will transmit respective signals to the monitoring module 2 indicating unauthorized opening of the door.

A Third Embodiment of the Displacement Sensor 4

Figure 6:
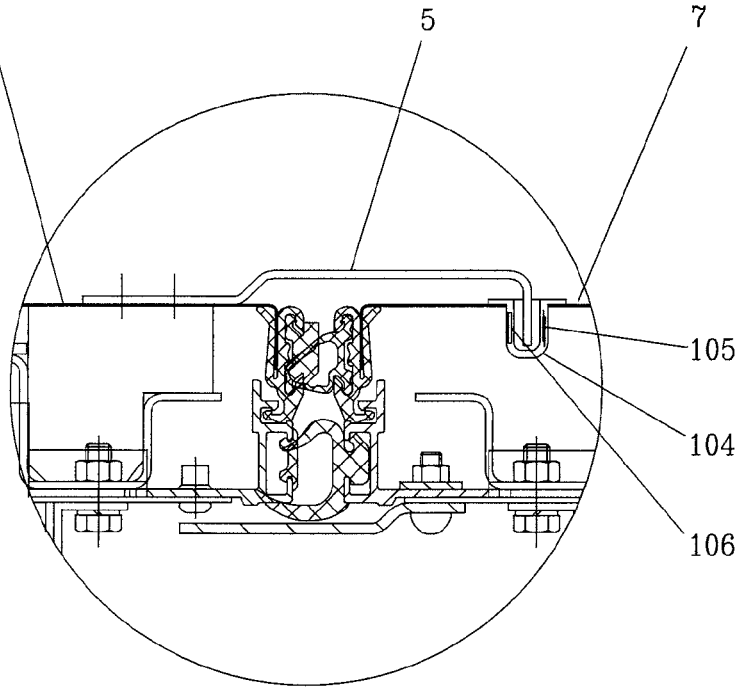
FIG. 6 is an enlarged view of part A in FIG. 3, showing a third embodiment of the displacement sensor.

As shown in FIG. 6, in this embodiment, the displacement sensor is implemented as a reed switch 105. In addition, the inner side structure of the door panel 10 comprises a U-shaped member 104 fixed to the inner lining 7 of the door panel 10. The reed switch 105 is mounted to one of two opposite side walls of the U-shaped member 104, and a magnetic member 106 such as magnet, magnetic rubber or the like is mounted to the other of the two opposite side walls of the U-shaped member 104. Here, the free end of the detection plate 5 is formed with a bent portion which may be inserted into a gap between the two opposite side walls of the U-shaped member 104 when the door is closed, so as to prevent magnetic lines of the magnetic member 106 from being reached the reed switch 105. The reed switch 105 may be a normally closed type or a normally open type, depending on the specific requirement for an internal arrangement of the monitoring module 2.

Instead of the reed switch 105, other proximity switches like capacitive proximity switches, inductive proximity switches may be used.

The U-shaped member 104 is preferably made of non-magnetic materials such as plastic materials so as to avoid affecting magnetic lines of the magnetic member 106. The magnetic member 106 and the reed switch 105 may be disposed within the two opposite side walls of the U-shaped member 104, and alternatively may be attached to inner surfaces or outer surfaces of the two side walls of the U-shaped member 104. Particularly, when the U-shaped member 104 is made of metal materials, the magnetic member 106 and the reed switch 105 are preferably to be respectively attached to inner surfaces of the two side walls of the U-shaped member 104.

When the bent portion of the free end of the detection plate 5 is inserted into the gap between the magnetic member 106 and the reed switch 105 and thus prevents a majority of magnetic lines of the magnetic member 106 from being reached the reed switch 105, or reversely the bent portion of the free end of the detection plate 5 retreats from the gap between the magnetic member 106 and the reed switch 105, the state of the reed switch 105 will be switched from "OFF" to "ON" (a normally open type), or from "ON" to "OFF" (a normally closed type), and a signal indicating the door is opened or closed is transmitted to the monitoring module 2. Accordingly, once occurrence of unauthorized opening of the door, the reed switch 105 will transmit respective signals to the monitoring module 2 indicating unauthorized opening of the door.

A Fourth Embodiment of the Displacement Sensor 4

Figure 8:
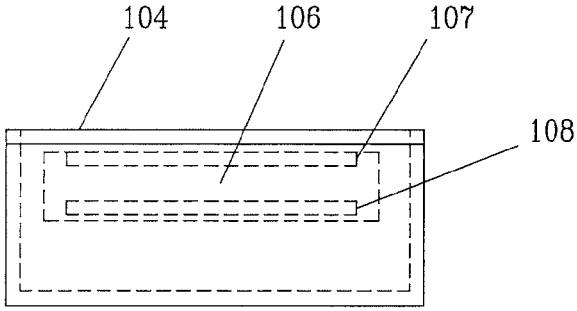
FIG. 8 is a side view showing the U-shaped member used in the fourth embodiment of the displacement sensor.

As shown in FIGS. 6 and 8, the structure in accordance with the present embodiment is substantially the same as that of the third embodiment, except that two reed switches 107 and 108 electrically connected in series are used. The two reed switches 107 and 108 are substantially in parallel with the inner lining 7 of the door panel 10, and are spaced apart from each other so that the bent portion of the free end of the detection plate 5 may in steps shield the magnetic lines of the magnetic member 106 from reaching the reed switches 107 and 108. As for the two reed switches, the reed switch 107 which is located adjacent to the opening of the U-shaped member is a normally open type, and the reed switch 108 which is located away from the opening of the U-shaped member is a normally closed type.

Figure 7:
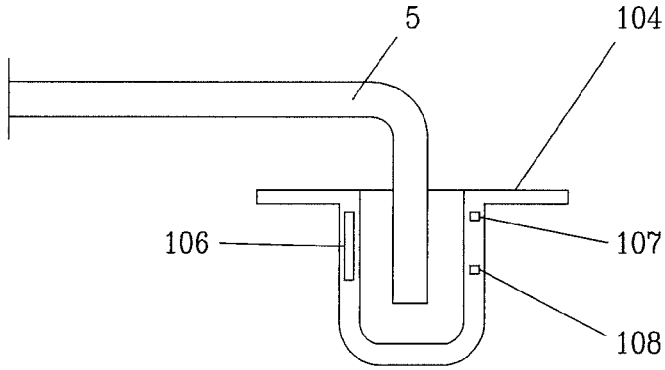
FIG. 7 shows a fourth embodiment of the displacement sensor.
Figure 9:
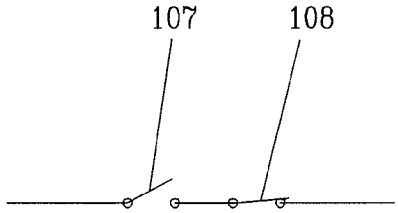
FIG. 9 shows a circuit diagram represented by the two reed switches in the fourth embodiment of the displacement sensor.

As shown in FIGS. 7 and 9, before the bent portion of the free end of the detection plate 5 is inserted between the magnetic materials 106 and the reed switch 107, the reed switch 107 is in an "OFF" state and the reed switch 108 is in an "ON" state so that the circuit involving the reed switches 107 and 108 are powered off. When the bent portion of the free end of the detection plate 5 is inserted between the magnetic materials 106 and the reed switch 107, the state of the reed switch 107 changes from "OFF" to "ON", and thus the circuit involving the reed switches 107 and 108 is powered on and simultaneously a signal indicating the status of the door is transmitted to the monitoring module 2. As the bent portion of the free end of the detection plate 5 is further inserted between the magnetic material 106 and the reed switch 108, the state of the reed switch 108 changes from "ON" to "OFF", and thus the circuit involving the reed switches 107 and 108 is again powered off. The varying processes of the reed switches 107 and 108 when the bent portion of the detection plate 5 retreats from the gap between the two opposite side walls of the U-shaped member are just contrary to those when the bent portion of the detection plate 5 inserts into the gap. Thus, upon occurrence of unauthorized opening of door, a corresponding signal may be transmitted to the monitoring module 2. The present embodiment is advantageous in that power consumption of the security device may be reduced.

What is claimed is:

1. A refrigerated container, comprising a security device and a door composed of a first door panel and a second door panel, said security device including:

a detection plate having a first end fixed to an inner side structure of the first door panel, and a second opposite end as a free end extending towards the second door panel and being positioned behind an inner side structure of the second door panel when the door is closed;

a displacement sensor fixed to the inner side structure of the second door panel and positioned adjacent to the free end of the detection plate so as to cooperate with the free end of the detection plate and to thus detect a relative displacement between the two door panels;

a monitoring module electrically connected to the displacement sensor to receive and process outputs from the displacement sensor; and an antenna electrically connected to the monitoring module to receive and emit outputs from the monitoring module;

wherein said displacement sensor, monitoring module and antenna are separately arranged in the door, and said monitoring module is arranged within a heat insulating layer in the first door panel or the second door panel, and said antenna is provided at an outer side of the first door panel or the second door panel.

2. The refrigerated container as claimed in claim 1, wherein in case of arranging on the same door panel, said displacement sensor, monitoring module and antenna are connected with each other by means of electrical wires or cables embedded into said heat insulating layer of said the same door panel.

3. The refrigerated container as claimed in claim 1, wherein said displacement sensor is a travel switch, said inner side structure of the second door panel comprises an inner lining, and the travel switch is fixed to the inner lining; and a contact pin of the travel switch protrudes out of the inner lining, and said free end of the detection plate is configured to press against the contact pin of the travel switch when the door is closed and release the contact pin of the travel switch when the door is opened so as to switch states of the travel switch.

4. The refrigerated container as claimed in claim 1, wherein said displacement sensor is a Hall sensor, said inner side structure of the second door panel comprises an inner lining, and the Hall sensor is fixed to the inner lining; and said free end of the detection plate includes magnetic conductive materials configured to face the Hall sensor when the door is closed.

5. The refrigerated container as claimed in claim 1, wherein said displacement sensor is a Hall sensor, said inner side structure of the second door panel comprises an inner lining, and the Hall sensor is fixed to the inner lining; and said free end of the detection plate includes a magnetic member, and said magnetic member is fixed to a portion of said detection plate which faces the Hall sensor when the door is closed.

6. The refrigerated container as claimed in claim 1, wherein said displacement sensor is a proximity switch, and said inner side structure of the second door panel comprises an inner lining and a U-shaped member fixed to the inner lining; and the proximity switch is fixed to one of two opposite side walls of the U-shaped member, and a magnetic member opposite to the proximity switch is fixed to the other one of the two opposite side walls of the U-shaped member; and said free end of the detection plate includes a bent portion which is inserted into a gap between the two opposite side walls of the U-shaped member and prevents magnetic lines of the magnetic member from reaching the proximity switch when the door is closed.

7. The refrigerated container as claimed in claim 6, wherein said proximity switch is a normally closed type or a normally open type of reed switch.

8. The refrigerated container as claimed in claim 6, wherein said proximity switch includes two reed switches electrically connected in series and arranged to be substantially in parallel with the inner lining and to be spaced apart from each other; and one of said two reed switches near an opening of said U-shaped member is a normally open type, the other one away from the opening of said U-shaped member is a normally closed type.

9. The refrigerated container of as claimed in claim 1, further comprising a reinforcer of heat-insulating materials arranged within the first door panel and abutting against an inner lining of the first door panel, said detection plate being fixed to the reinforcer of heat-insulating materials.

10. The refrigerated container of as claimed in claim 2, further comprising a reinforcer of heat-insulating materials arranged within the first door panel and abutting against an inner lining of the first door panel, said detection plate being fixed to the reinforcer of heat-insulating materials.

11. The refrigerated container of as claimed in claim 3, further comprising a reinforcer of heat-insulating materials arranged within the first door panel and abutting against an inner lining of the first door panel, said detection plate being fixed to the reinforcer of heat-insulating materials.

12. The refrigerated container of as claimed in claim 4, further comprising a reinforcer of heat-insulating materials arranged within the first door panel and abutting against an inner lining of the first door panel, said detection plate being fixed to the reinforcer of heat-insulating materials.

13. The refrigerated container of as claimed in claim 5, further comprising a reinforcer of heat-insulating materials arranged within the first door panel and abutting against an inner lining of the first door panel, said detection plate being fixed to the reinforcer of heat-insulating materials.

14. The refrigerated container of as claimed in claim 6, further comprising a reinforcer of heat-insulating materials arranged within the first door panel and abutting against an inner lining of the first door panel, said detection plate being fixed to the reinforcer of heat-insulating materials.

15. The refrigerated container of as claimed in claim 7, further comprising a reinforcer of heat-insulating materials arranged within the first door panel and abutting against an inner lining of the first door panel, said detection plate being fixed to the reinforcer of heat-insulating materials.

16. The refrigerated container of as claimed in claim 8, further comprising a reinforcer of heat-insulating materials arranged within the first door panel and abutting against an inner lining of the first door panel, said detection plate being fixed to the reinforcer of heat-insulating materials.

17. The refrigerated container as claimed in claim 1, wherein said antenna is arranged within an anti-collision block mounted on a pivot hinge of the first door panel or the second door panel.

* * * * *